US006821071B2

(12) United States Patent
Woolslayer et al.

(10) Patent No.: US 6,821,071 B2
(45) Date of Patent: Nov. 23, 2004

(54) AUTOMATED PIPE RACKING PROCESS AND APPARATUS

(75) Inventors: Joseph R. Woolslayer, Tulsa, OK (US); Rod Duncan, Fort Gibson, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 72 days.

(21) Appl. No.: 10/254,494

(22) Filed: Sep. 25, 2002

(65) Prior Publication Data

US 2004/0057815 A1 Mar. 25, 2004

(51) Int. Cl.[7] ..... E21B 19/14
(52) U.S. Cl. ..... 414/22.63; 175/85
(58) Field of Search ..... 414/22.63, 22.65, 414/22.68; 175/52, 85

(56) References Cited

U.S. PATENT DOCUMENTS

| | | | | | |
|---|---|---|---|---|---|
| 1,776,605 | A | * | 9/1930 | Tibbetts | 414/22.63 |
| 3,987,910 | A | * | 10/1976 | Brunato | 414/22.63 |
| 4,013,178 | A | * | 3/1977 | Brown et al. | 414/22.63 |
| 4,042,123 | A | * | 8/1977 | Sheldon et al. | 414/22.71 |
| 4,044,895 | A | * | 8/1977 | Adair | 414/22.63 |
| 4,117,941 | A | * | 10/1978 | McCleskey et al. | 414/22.63 |
| 4,269,554 | A | * | 5/1981 | Jackson | 414/22.63 |
| 4,725,179 | A | * | 2/1988 | Woolslayer et al. | 414/22.65 |
| 4,744,710 | A | * | 5/1988 | Reed | 414/22.63 |
| 4,834,604 | A | * | 5/1989 | Brittain et al. | 414/22.55 |
| 4,850,439 | A | * | 7/1989 | Lund | 175/52 |
| 5,284,375 | A | * | 2/1994 | Land, III | 294/88 |
| 6,089,333 | A | * | 7/2000 | Rise | 175/85 |
| 6,113,334 | A | * | 9/2000 | Riva | 414/22.63 |
| 6,361,262 | B1 | * | 3/2002 | Roodenburg | 414/22.51 |
| 6,513,605 | B1 | * | 2/2003 | Lodden | 175/52 |
| 6,550,128 | B1 | * | 4/2003 | Lorenz | 29/464 |
| 6,591,471 | B1 | * | 7/2003 | Hollingsworth et al. | 29/407.09 |
| 6,591,904 | B2 | * | 7/2003 | Cicognani | 166/77.51 |

* cited by examiner

*Primary Examiner*—Douglas Hess
(74) *Attorney, Agent, or Firm*—Head, Johnson & Kachigian

(57) ABSTRACT

An automated pipe racking apparatus for a drilling rig having an elevator suspended over a well bore. An arm support member is rotatable about an axis parallel to the well bore. A gripper arm extends from the arm support member along an axis normal to the axis of rotation of the arm support member. A gripper head assembly extends from the gripper arm, the gripper head assembly having a pair of opposed, arcuate gripper fingers, each said finger rotatable by a motor.

11 Claims, 10 Drawing Sheets

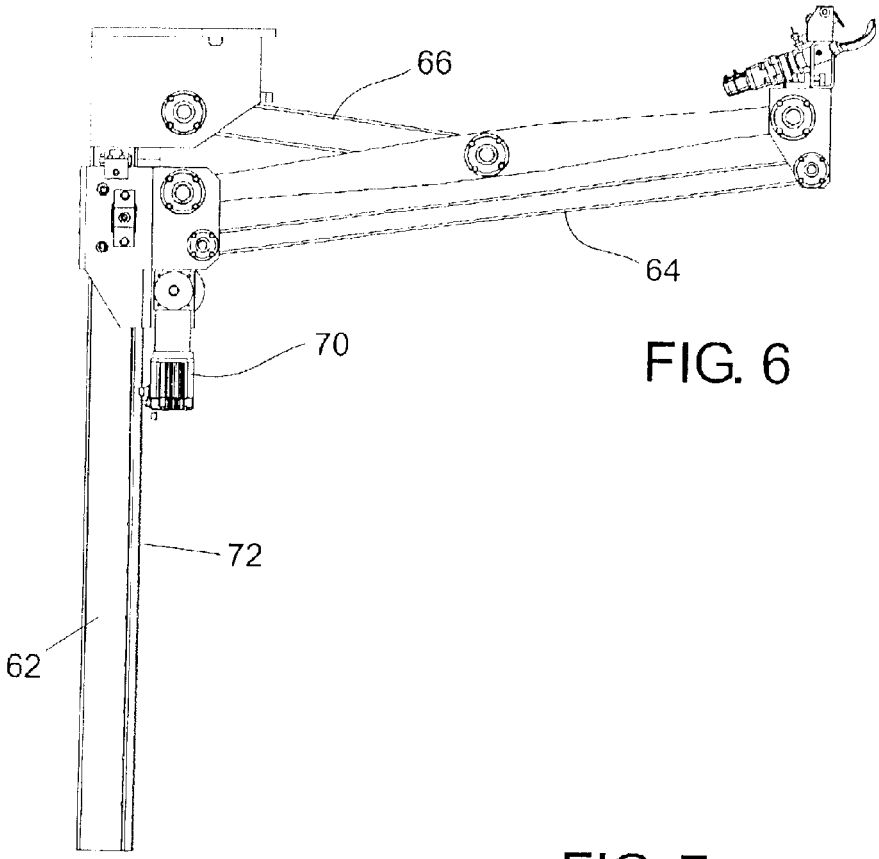
FIG. 6
FIG. 7
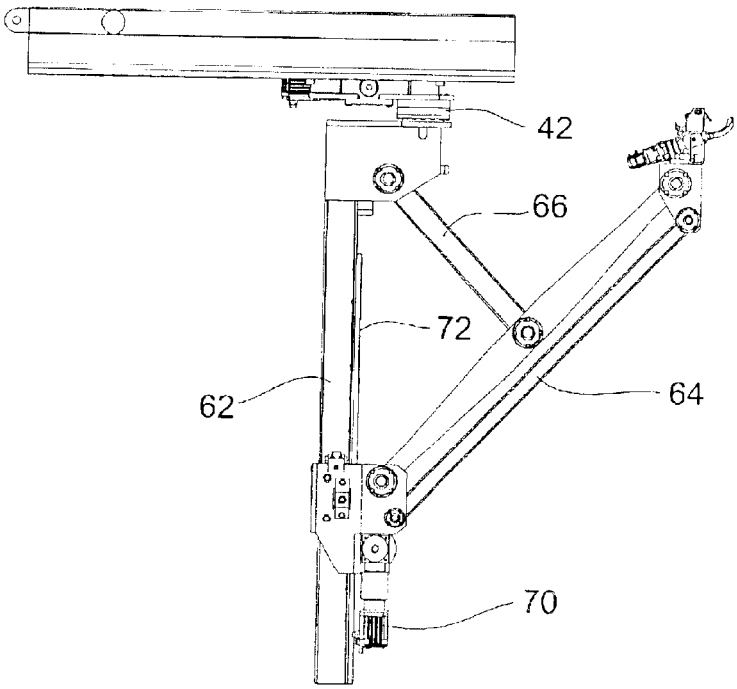

AUTOMATED PIPE RACKING PROCESS AND APPARATUS

BACKGROUND OF THE INVENTION

1. Field of the Invention

The present invention is directed to an automatic pipe racking apparatus and process to couple and uncouple lengths of pipe or drill collars and to store and retrieve lengths of pipe or drill collars.

2. Prior Art

Drilling rigs utilize a mast with a string of drill pipes suspended therefrom and having a drill bit mounted on the lower end thereof. A drill collar or collars having a larger diameter than said drill pipes are also utilized.

It is periodically necessary to pull the drill string from the well bore in order to change the drill bit, to perform various testing, or to run other equipment into the well bore at the end of the drill string. In the standard process to pull drill pipe from the bore, an elevator is connected to the drill pipe and a traveling block is raised on the mast until a stand of pipe extends above the drilling rig floor. The stand may include three sections of pipe totaling up to 90 feet in length. The connection between the pipe stand and the remainder of the drill string is unthreaded. Thereafter, the lower end of the stand is moved onto a support pad or set back by personnel. In the normal procedure, a man positioned in the upper portion of the rig disconnects the upper end of the stand from the elevator and places the upper end of the stand between a set of racking fingers. The traveling block may then be lowered to pick up the drill string and the process is repeated.

The reverse process is performed when running the drill string back into the well bore. A man on a platform will remove a stand of pipe and connect it to the traveling block. When the traveling block is lifted, the lower end of the stand of pipe will swing into position above the well bore. The stand of pipe will then be connected to the remainder of the drill string.

There have been a number of attempts to automate the pipe racking procedure including that shown in Assignee's U.S. Pat. No. 4,725,179 which utilizes an arm assembly having a first arm and a second arm.

There remains a need to provide an automated pipe racking process and apparatus which will eliminate personnel on the mast.

There remains a need to provide an automated pipe racking process and apparatus which will grasp and move different diameters of pipe or drill collars. There also remains a need to provide an automated pipe racking apparatus which will accommodate either pipe or drill collars.

It is desirable to provide an automated pipe racking process and apparatus that maybe retrofit to existing manual racking systems on drilling rigs.

Finally, there remains a need to provide an automated pipe racking process and apparatus which may be alternated with a manual racking system as desired from time to time.

SUMMARY OF THE INVENTION

The present invention provides an automated pipe racking apparatus and process which will be utilized with a drilling rig having a mast with a traveling block suspended over the center line of a well bore. An elevator or set of elevators may be suspended from the traveling block for grasping a drill pipe or drill stand.

A racking assembly having a generally U-shaped frame is mounted on the mast. The racking assembly includes a first set of parallel racking fingers and a second set of parallel racking fingers with a space therebetween. The racking fingers are arranged to form a plurality of slots between adjacent fingers so that the pipe stands may be stored in the slots between the fingers.

In one preferred embodiment of the invention, an arm assembly is suspended from a carriage which is, in turn, mounted to move on the underside of a working board which is mounted and connected to the racking assembly and which extends between the first set of fingers and the second set of fingers. The carriage includes a set of wheels or rollers which travel on a track formed by the working board. The carriage is powered by an electric motor activated by a control.

The arm assembly rotates about an axis parallel to the well bore. The arm assembly includes an arm support member, a gripper arm, and a connecting arm. Rotation of the arm assembly permits movement between the well bore and the first set of fingers or the second set of fingers. Rotation of the arm assembly is accomplished by an electric motor activated by a control.

The gripper arm moves in relation to the arm support member. The arm support member includes a rack which engages a pinion mechanism driven by an electric motor activated by a control. Accordingly, the end of the gripper arm will be moved by movement of the motor. A gripper head assembly extends from the gripper arm. A pair of arcuate, rotating fingers extend from mounting bosses which extend from a base mount of the gripper head assembly.

Between the rotating fingers is located a lever. When a drill stand is between the fingers, the lever will be depressed which activates a pipe detection sensor. When in the storage position, each pipe stand will rest on one of two base grids. Each grid contains multiple rows with multiple cells in each grid. When the pipe stand is on a cell, it will act as a switch which will send a signal a control. Once the control signal is received, the control will activate action of the carriage, arm support member, gripper arm and gripper head assembly to engage the top of the drill pipe stand.

BRIEF DESCRIPTION OF THE DRAWINGS

FIG. 6 and FIG. 7 show alternate positions of a gripper arm and gripper head assembly of the pipe racking apparatus;

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
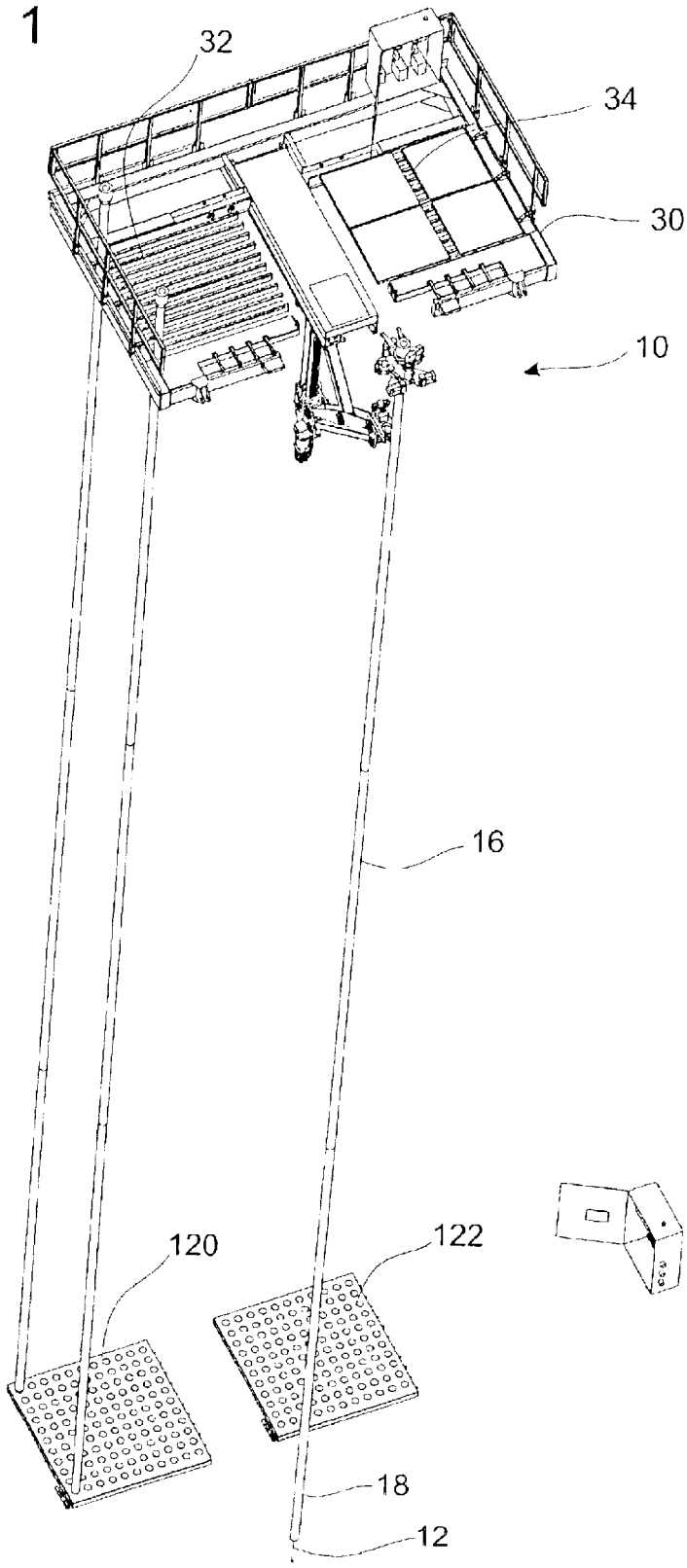
FIG. 1 is a perspective view of an automated pipe racking apparatus constructed in accordance with the present invention apart from the drilling rig with which it would be utilized.

Referring to the drawings in detail, FIG. 1 illustrates a perspective view of an automated pipe racking apparatus 10 constructed in accordance with the present invention.

A drilling rig will often include a mast having a traveling block suspended over the centerline of a well bore 12 (seen in dashed lines).

An elevator or set of elevators may also be suspended from the traveling block for grasping a drill pipe or drill stand. A drill pipe stand 16 consists of at least one pipe section and is often composed of three substantially identical pipes joined end to end and threaded together at joints. Each of the pipes on the lower end, such as stand 16, includes a male threaded coupling 18 that may be threadably engaged with a female-threaded coupling 20, such as at the top of another stand.

Accordingly, a continuous string of drill pipes can be made up and then lowered into the well bore 12. Two different operations are performed. As the pipe stands are successively lowered into the well, they are retrieved from a racking assembly, connected to the existing drill string, and then inserted into the well bore 12. Conversely, when the drill pipe stands are removed from the well, they are lifted out of the well bore, disconnected from the drill string, and placed for storage in a racking assembly.

As seen in FIG. 1, a racking assembly 30 has a generally U-shaped frame which is mounted on the mast (not shown).

The racking assembly 30 includes a first set of parallel racking fingers 32 and a second set of parallel racking fingers 34 with a space therebetween. The racking fingers are arranged to form a plurality of slots between adjacent fingers. The slots are slightly wider than the diameter of the drill stand. The pipe stands 16 are stored in the slots between the racking fingers.

Figure 2:
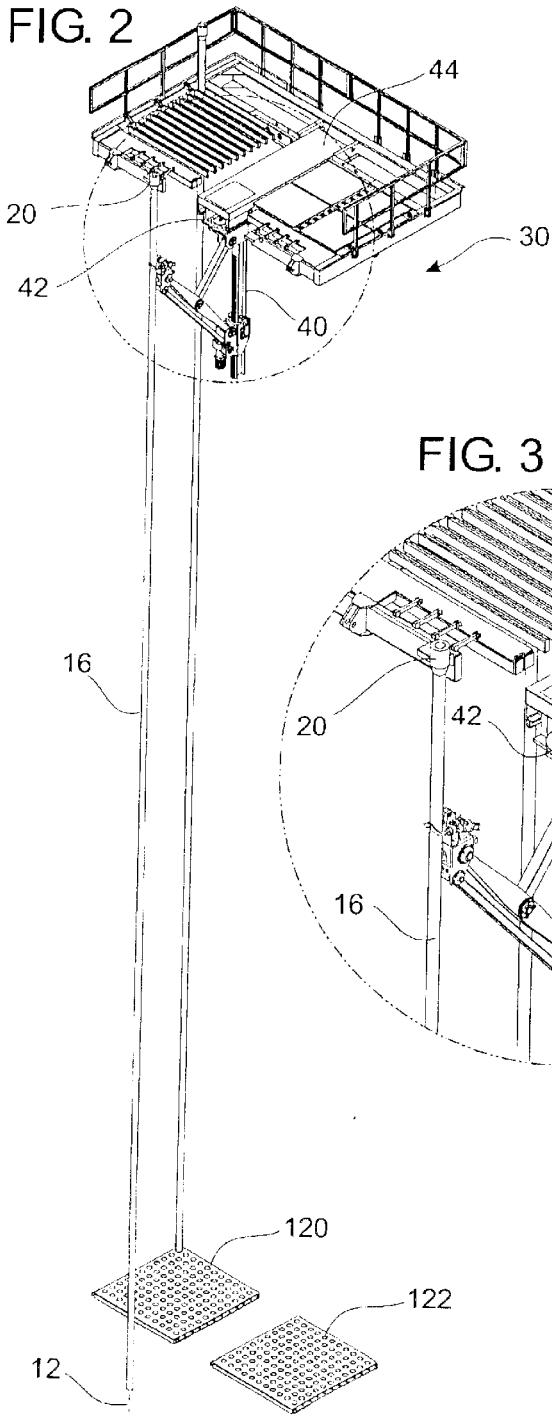
FIG. 2 shows an alternate perspective view of the automated pipe racking apparatus shown in FIG. 1.
Figure 3:
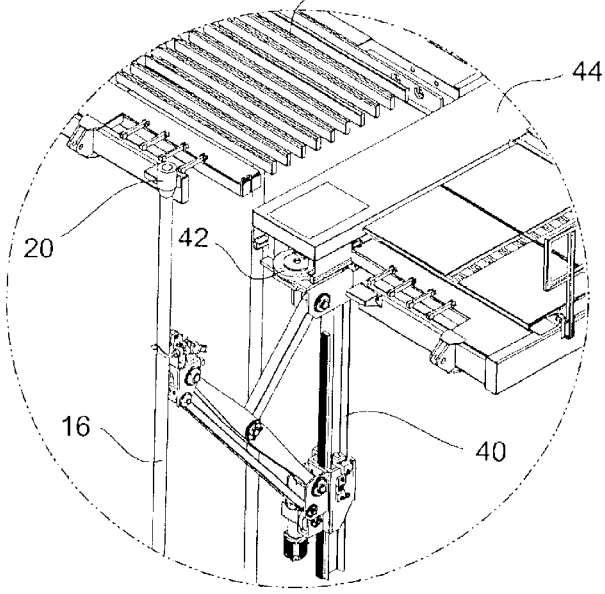
FIG. 3 illustrates an enlarged partial view of the portion of the automated pipe racking apparatus shown in FIG. 2.

FIG. 2 shows an alternate perspective view of the automated pipe racking apparatus 10 of the present invention shown in FIG. 1, while FIG. 3 illustrates an enlarged partial view (of the portion within the dashed-dotted lines) for ease of comprehension.

An arm assembly 40 (to be described in detail) is suspended from a carriage 42. The carriage 42 is, in turn, rollingly mounted on the underside of a working board 44 which is connected to the racking assembly 30 and which extends in the space between the first set of fingers 32 and the second set of fingers 34.

Figure 4:
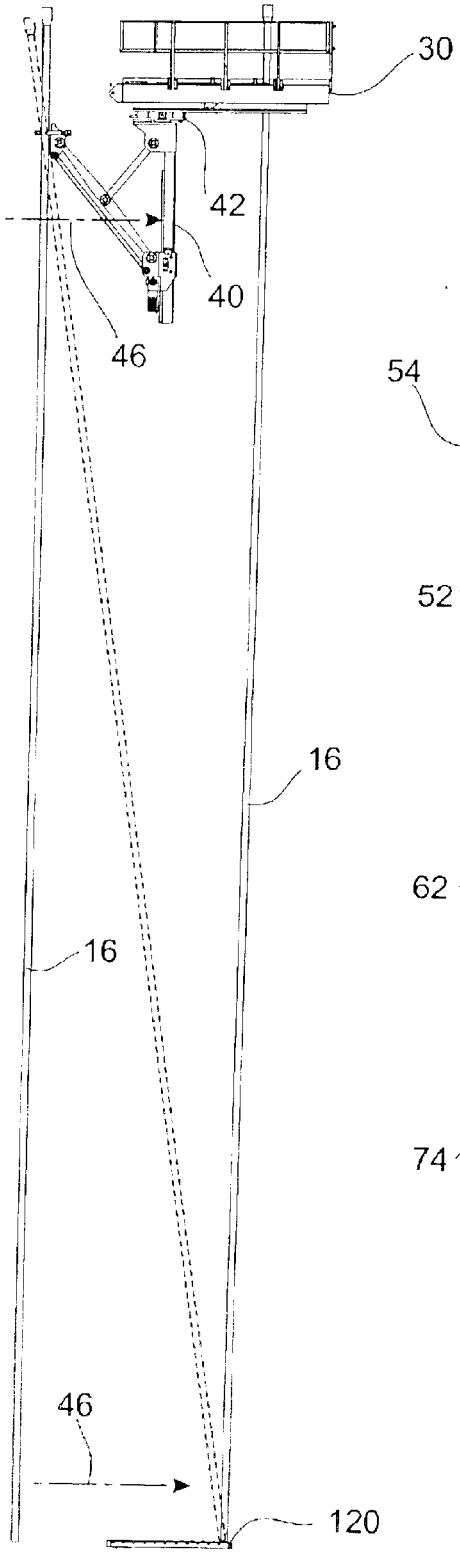
FIG. 4 illustrates a side view of the automated pipe racking apparatus shown in FIGS. 1 through 3.

FIG. 4 illustrates a side view of the automated pipe racking apparatus 10. The carriage 42 moves from a position shown in FIGS. 1, 2 and 3 and in the direction shown by arrow 46.

Figure 5:
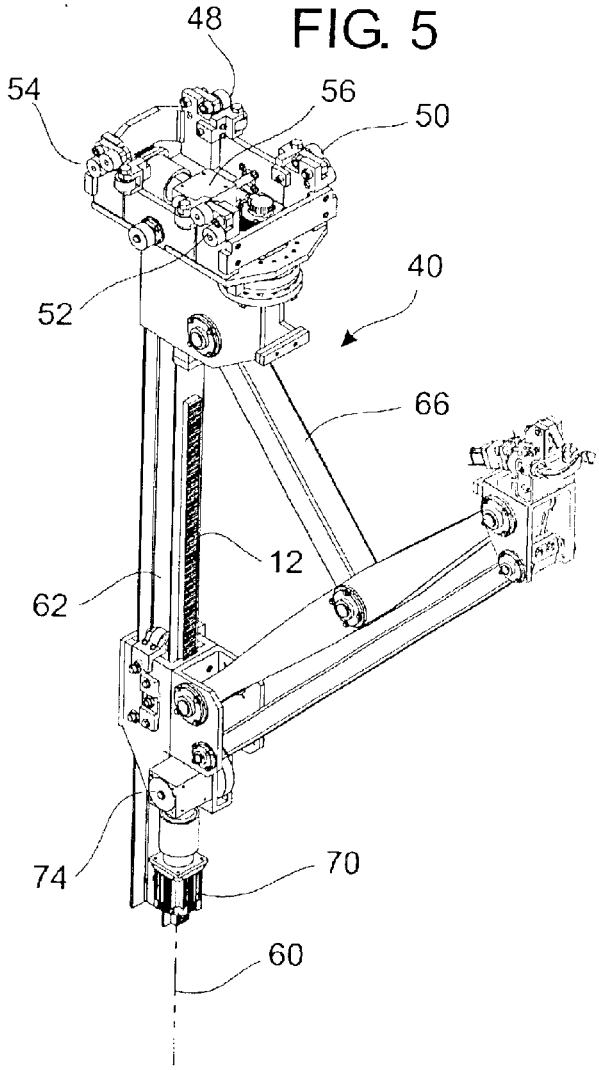
FIG. 5 illustrates an arm assembly and carriage apart from the pipe racking apparatus.

FIG. 5 illustrates a perspective view of the arm assembly 40 and the carriage 42 apart from the apparatus 10. The carriage 42 includes a set of wheels or rollers 48, 50, 52 and 54 which travel on a track formed by the working board 44. The carriage is powered by an electric motor 56 activated by a control.

The arm assembly 40 includes an arm support member 62, a gripper arm 64 and a connecting arm 66. As seen in FIG. 5, the arm assembly 40 rotates about an axis 60 (shown by dashed lines) parallel to the well bore 12. Rotation of the arm assembly 40 permits movement between the well bore and the first set of fingers or the second set of fingers. Rotation of the arm assembly 40 is accomplished by an electric motor 70 activated by a control.

One end of the gripper arm terminates in a bracket and is engaged with the arm support member 62 so that the gripper arm 64 moves in relation to the arm support member 62. Arm support member 62 includes a rack 72 which engages with a pinion mechanism (not seen) driven by an electric motor 74. The connecting arm 66 is pivotally connected to the arm support member 62 and the gripper arm 64. Accordingly, the end of the gripper arm 64 moves in the direction illustrated by arrow 76. This causes extension or retraction of the opposite end of the gripper arm.

FIGS. 6 and 7 illustrate alternate positions of the gripper arm 64. FIG. 6 shows the gripper arm fully extended.

Figure 8:
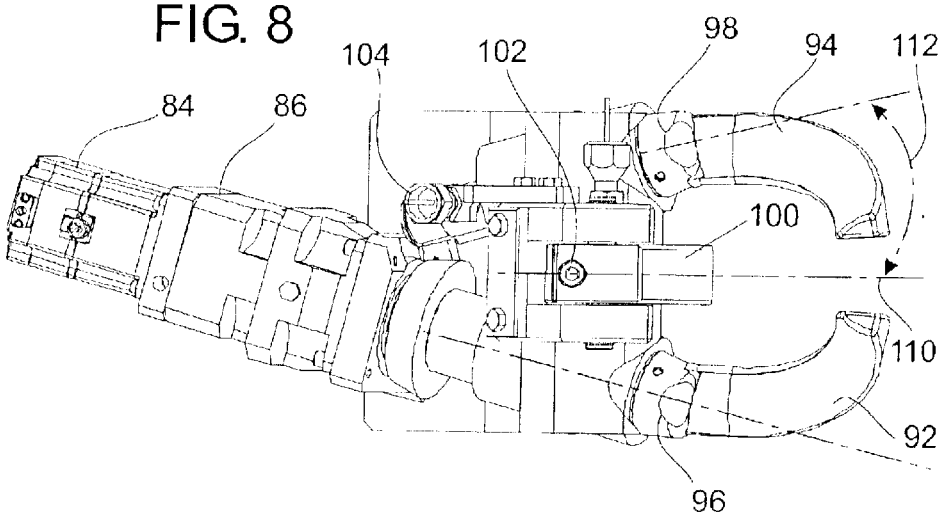
FIGS. 8 through 16 show alternate positions of the gripper head assembly of the automated pipe racking apparatus.
Figure 9:
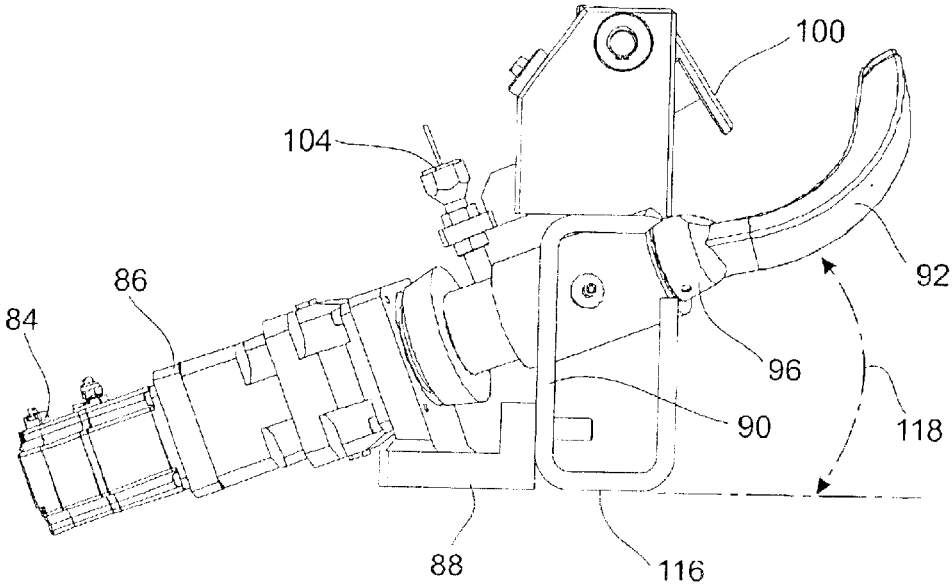

FIGS. 8 through 16 illustrate a gripper head assembly 80 which extends from the gripper arm 64. The gripper arm 64 in the present embodiment is comprised of a pair of parallel arms so that the gripper head assembly remains in a single plane. FIG. 8 illustrates a top view and FIG. 9 illustrates a side view of the gripper head assembly apart from gripper arm 64. The gripper head assembly includes a servo motor 84 which operates in conjunction with a gear box 86 which, in turn, is activated by a control.

The gripper head assembly 80 includes a motor mount 88 which will connect with the gripper arm 64 (not seen in FIG. 8). The motor mount 88 is also connected to a base mount 90. A pair of arcuate, rotating fingers 92 and 94 extend from mounting bosses 96 and 98, respectively, on the base mount 90. Each of the fingers 92 and 94 is rotated by the servo motor 84 and gear box 86.

Between the fingers 92 and 94 is located a lever 100. When the gripper head assembly is moved and a drill stand is between the fingers, the lever 100 will be depressed which activates a pipe detection sensor 102. A proximity sensor 104 verifies that a pipe is in the gripper assembly between the fingers.

The gripper head assembly 80 also includes a homing sensor 106 which, upon each use, will rotate each of the fingers to a 0° starting point and will also be a positive indicator to the control system.

As best seen in FIG. 8, each of the rotating fingers 92 and 94 is arranged at an angle between a first center line axis 110 (shown by dashed line) at approximately 15° as illustrated by arrow 112. The rotating fingers may be arranged at an angle of between 10° to 20°.

As best seen in FIG. 9, the base mount 90 includes a base 116 which forms a base plane.

Each of the fingers 92 and 94 extends at an angle from the base plane of approximately 20° as shown by arrow 118. The fingers may extend at an angle of between 15° to 25°.

Figure 10:
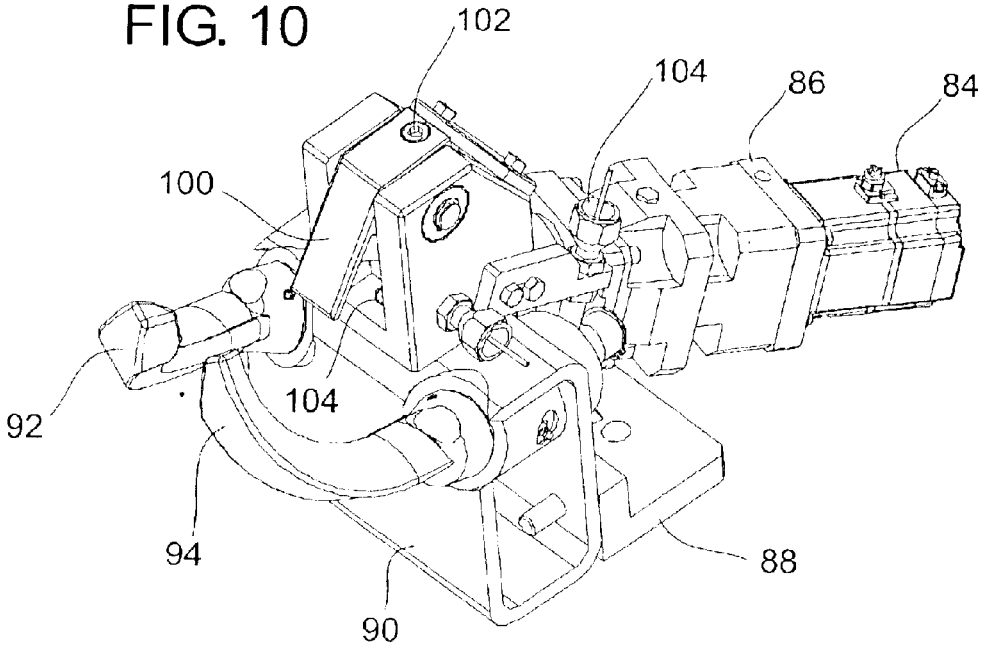

FIG. 10 is a perspective view of the gripper head assembly. As best seen in FIG. 10, each of the rotating fingers 92 and 94 extends at an angle from the axis of its mounting boss 96 and 98 at an angle so that each finger is slightly pitched or skewed from its mounting axis at approximately 15° as illustrated by arrow 120.

These angles, taken together, form a compound set of angles which are useful in performing various tasks and engaging different diameter pipes.

Figure 11:
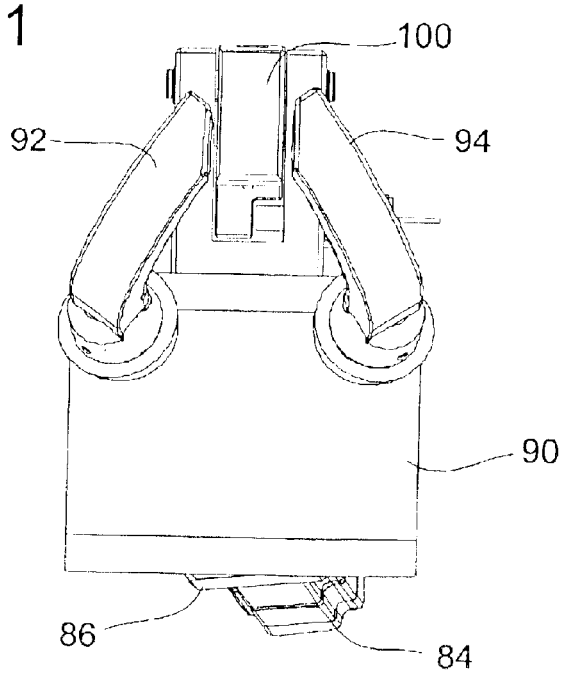
Figure 12:
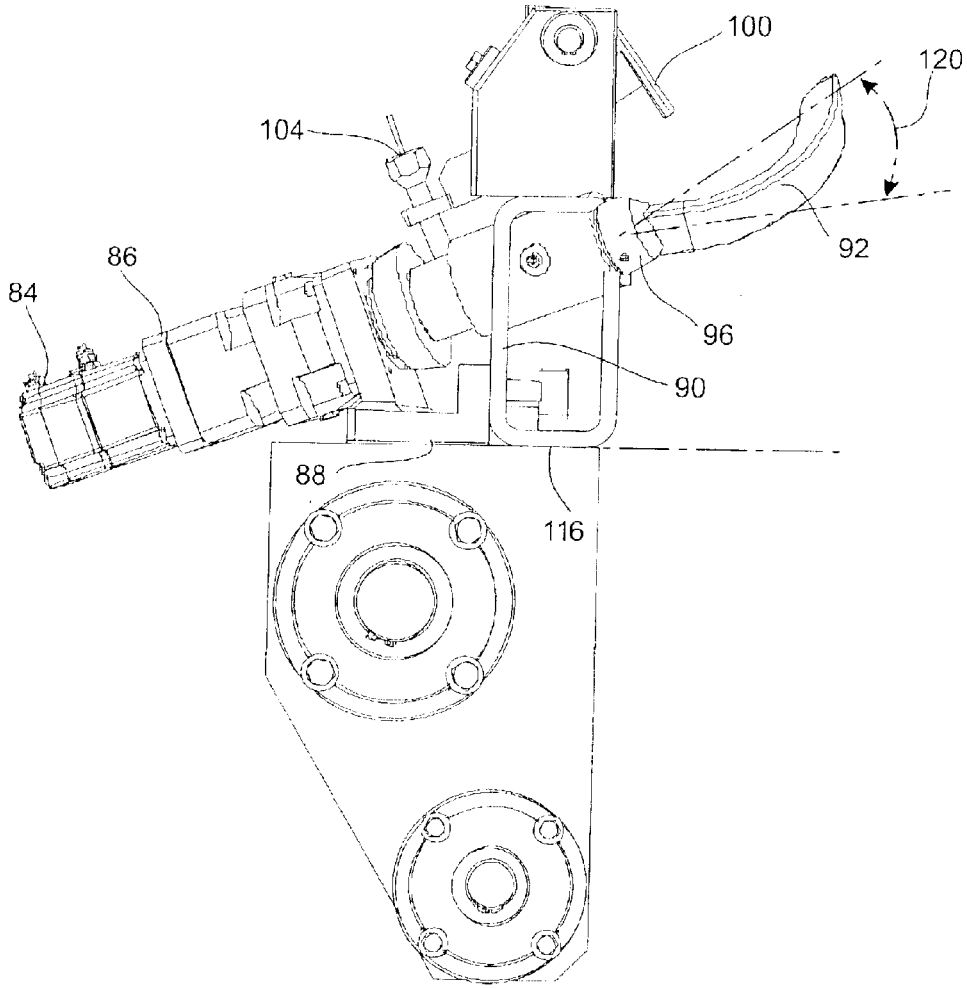

FIG. 11 illustrates a front view of the gripper head assembly 80 while FIG. 12 illustrates the gripper head assembly 80 connected to the gripper arm.

Figure 13:
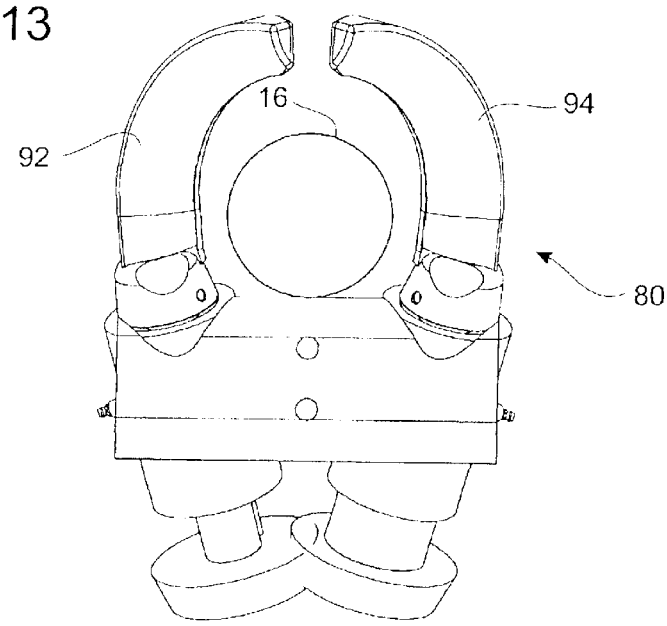

FIGS. 13 through 16 show the rotating fingers in different positions for performing different tasks. FIG. 13 illustrates the rotating fingers 92 and 94 in a closed gripper position for gripping the drill pipe stand 16 such as a 4" diameter pipe.

Figure 14:
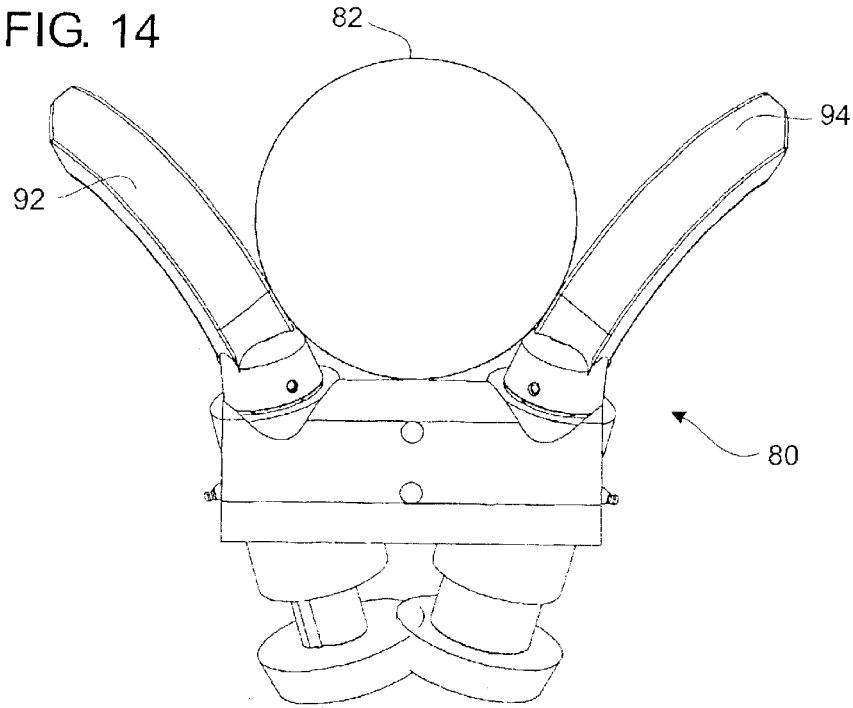
Figure 15:
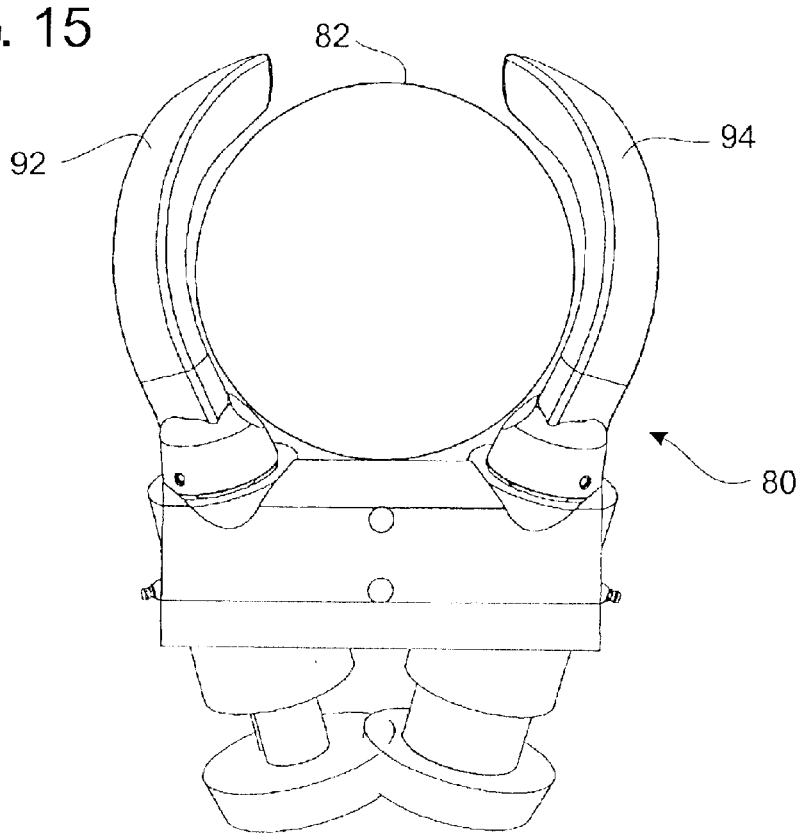
Figure 16:
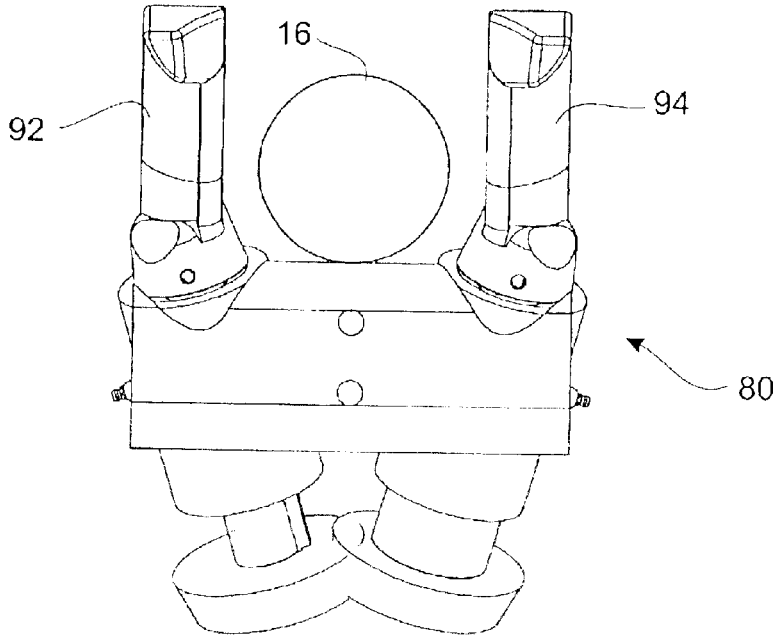

FIG. 14 shows the fingers 92 and 94 in the wide open position such as when the gripper head approaches a pipe stand at the well bore or a drill collar 82. FIG. 15 shows the fingers 92 and 94 in closed position when surrounding a larger diameter drill collar 82. Finally, FIG. 16 illustrates an open position of the rotating fingers 92 and 94 so that the fingers are in the narrowest position in order to fit between and move within the slots of the rotating fingers 92 or 94 on the racking assembly.

Figure 17:
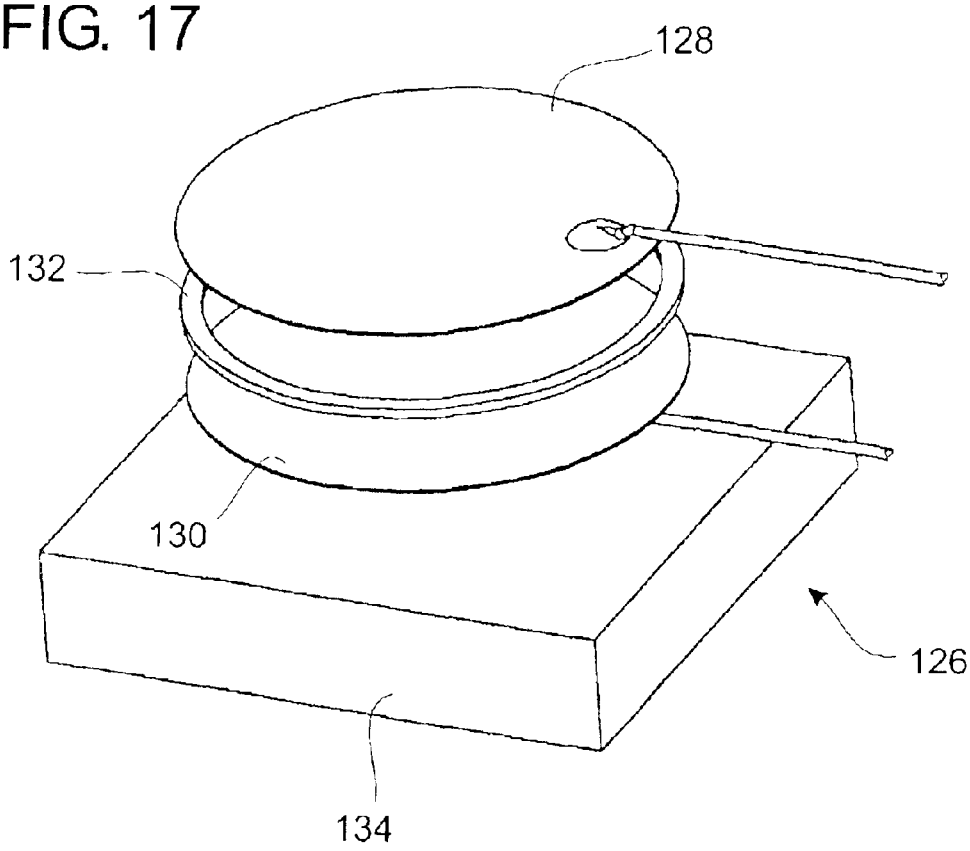
FIG. 17 illustrates an exploded view of a cell of a grid of the automated pipe racking apparatus shown in FIGS. 1 and 2.

Returning to a consideration of FIGS. 1 and 2 and a consideration of the exploded view shown in FIG. 17, when in the storage position, each of the pipe stands 16 will rest on a base grid 122 or 124. Each of the base grids contains multiple rows with multiple cells in each grid. By way of example, in the present embodiment, the base grids 122 and 124 in FIGS. 1 and 2 each have eleven rows, each having eleven cells in each row plus optional drill collar cells to receive the larger diameter drill collars. FIG. 17 shows an exploded view of one such cell 126. A pipe stand 16 will rest on an individual cell 126. Each cell 126 will act as a switch which will close a circuit and send a signal to a control.

Each pipe stand 16 typically weighs over a thousand pounds. The pipe stand will rest on a cell which will contain an upper contact plate 128, a lower contact plate 130, and a spacer gasket 132. The plates and spacer gasket may be encased within a urethane or polymer block 134. The weight of the pipe stand on the cell 126 will close a switch sending a signal to the control.

In the automated pipe racking process of the present invention, a pipe stand 16 having three pipe sections will be lifted from a well bore with an elevator extending from a traveling block on the mast. Once the elevator has lifted a stand from the well bore, the lower end of the pipe stand will be disconnected from the drill string. A lower end of the pipe stand will then be manually moved over one of the cells 126 as seen in FIG. 4. The pipe stand will be lowered on to the cell 126 on the grid 120. This will also signal the carriage and arm assembly to activate. The pipe stand 16 will then be captured with the gripper head assembly 80 as previously described. The elevator or elevators will then release the pipe stand 16 so that the gripper head assembly 80 secures the top end of the pipe stand 16. The upper end of the pipe stand 16 will then be moved to a chosen location in the racking assembly 30 through the combination of the movements previously described. These include movement of the carriage 42 along the working board 44, rotation of the arm support member 62 about an axis parallel to the well bore, and extending or retracting the gripper arm 64 of the arm assembly. The top of the pipe stand is moved in a slot between the fingers 32 of the racking assembly.

Each of the controls previously described may be wired to a control box 140 or 142. A central processing unit (not shown) can monitor and direct each control function.

Whereas, the present invention has been described in relation to the drawings attached hereto, it should be understood that other and further modifications, apart from those shown or suggested herein, may be made within the spirit and scope of this invention.

What is claimed is:

1. An automated pipe racking process for a drilling rig with an elevator suspended over a well bore, which process comprises:

lifting a pipe stand having at least one pipe section with said elevator;

moving a lower end of said pipe stand over a base pad;

setting said lower end of said pipe stand down onto a base pad;

capturing said pipe stand with a gripper head assembly having a pair of rotating arcuate fingers;

releasing said pipe stand from said elevator; and moving an upper end of said pipe stand with said gripper head assembly to a chosen location.

2. An automated pipe racking process as set forth in claim 1 wherein said steps of capturing said pipe stand and moving an upper end of said pipe stand includes rotating an arm support member about an axis parallel to said well bore.

3. An automated pipe racking process as set forth in claim 1 wherein each said pipe stand includes three said pipe sections.

4. An automated pipe racking process as set forth in claim 1 wherein said step of capturing said pipe stand is accomplished by rotating said fingers from an open to closed position.

5. An automated pipe racking apparatus for a drilling rig having an elevator suspended over a well bore, which apparatus comprises:

an arm assembly having an arm support member rotatable about an axis parallel to said well bore wherein said arm assembly is suspended from a carriage and said carriage moves along a working board mounted on and connected to a racking assembly;

a gripper arm extending from said arm support member along an axis normal to the axis of rotation of the arm support member; and a gripper head assembly extending from said gripper arm, said assembly having a pair of opposed, arcuate gripper fingers, each said finger rotatable by a motor.

6. An automated pipe racking apparatus as set forth in claim 5 including a set back grid having a plurality of pressure switches.

7. An automated pipe racking apparatus as set forth in claim 5 wherein each finger extends at an angle between 10° to 20° from a normal centerline axis.

8. An automated pipe racking apparatus as set forth in claim 7 wherein each said finger extends at an angle of approximately 15° from said centerline axis.

9. An automated pipe racking apparatus as set forth in claim 5 wherein said gripper head assembly includes a mount having a base and wherein said fingers extend at an angle between 15° to 25° from said base.

10. An automated pipe racking apparatus as set forth in claim 9 wherein said fingers extend at an angle approximately 20° from said base.

11. An automated pipe racking apparatus as set forth in claim 5 wherein each said finger has a mounting axis and each said finger extends at an angle between 10° to 20° from its mounting axis.

* * * * *